United States Patent [19]

Cooper

[11] Patent Number: 4,852,731

[45] Date of Patent: Aug. 1, 1989

[54] SLING-BOTTOM ARTICLE CARRIER

[75] Inventor: Leonard M. Cooper, West Monroe, La.

[73] Assignee: Manville Corporation, Denver, Colo.

[21] Appl. No.: 256,900

[22] Filed: Oct. 13, 1988

[51] Int. Cl.[4] ..... B65D 5/46; B65D 5/48

[52] U.S. Cl. ..... 206/167; 206/190; 229/52 BC

[58] Field of Search ..... 206/161–199, 206/141, 143; 229/52 BC

[56] References Cited

U.S. PATENT DOCUMENTS

| | | | |
|---|---|---|---|
| Re. 29,063 | 12/1976 | Graser | 206/162 |
| 2,637,480 | 5/1953 | Forrer | 206/167 |
| 2,760,677 | 8/1956 | Arneson | 206/167 |
| 2,783,916 | 3/1957 | Hodapp | 206/167 |
| 2,842,288 | 7/1958 | Dunning et al. | 206/167 |
| 2,905,359 | 9/1959 | Arneson | 206/190 |
| 2,983,406 | 5/1961 | Arneson | 206/165 |
| 3,198,381 | 8/1965 | Gioia | 206/166 |
| 3,760,978 | 9/1973 | Stone | 229/52 BC |
| 4,397,416 | 8/1983 | Bishop | 229/52 BC |

*Primary Examiner*—Stephen Marcus
*Attorney, Agent, or Firm*—John D. Lister

[57] ABSTRACT

A sling-bottom carrier adapted to carry long-necked beverage bottles. The carrier has an upper panel and a center partition with transverse cell-forming partitions. The center partition has a handle opening near the top and the top panel has a handle access opening overlying the center partition. A flap covering the access opening is folded down in use to allow a user to reach the handle opening. The front, back, bottom and top panels are formed from a continuous integral sheet, and the center partition sections of the carrier blank are on the same side of the sheet, thereby minimizing the amount of material needed. A reinforcing section makes the handle area in the center partition of triple thickness.

3 Claims, 7 Drawing Sheets

SLING-BOTTOM ARTICLE CARRIER

FIELD OF THE INVENTION

This invention relates to article carriers of the type used to carry beverage containers. More particularly, it relates to article carriers of the sling-bottom type.

BACKGROUND OF THE INVENTION

Article carriers used for carrying beverage containers generally fall into several different basic design categories. In the wrap-around type, the carrier is formed by folding a carton blank around an aligned group of beverage bottles or cans and mechanically fastening the ends of the blank together. In the sleeve-type, the carrier blank is folded and glued to form an open-ended sleeve into which the beverage containers are fed. The end panels are then closed and secured in subsequent operations. In both cases the heel portions of the beverage containers extend through cutouts in the panels to assist in holding the containers in place. Except for the protruding heel portions the resulting carrier can readily be designed to fully enclose beverage cans as well as bottles with very short necks, which is highly desirable for some markets. Similar carriers are also commonly designed to hold bottles with somewhat longer necks by provided openings in the top panel of the carton through which the cap of the bottle extends. This design serves to assist in holding the bottles in place.

One problem, however, is that these carriers do not lend themselves to designs suited for carrying tall articles, such as long-necked bottles. Basket-style carriers, which can be used to carry long-necked bottles and which contain transverse partitions for dividing the carrier into bottle-receiving cells, are lifted by means of a handle opening in a center partition. These are open carriers, however, which are not desirable for certain markets, and which do not have as much carton surface for carrying graphics or other advertising material.

Another type of carton, known as a sling-bottom carrier, has been used in the past but has not been well suited to serve as a completely enclosed carrier of long-necked bottles. Such carriers have long been known to be expensive due to the excessively large amount of paperboard required by the carrier blank. Further, they provide no practical handle means for carrying a fully enclosed carton.

In view of the lack of a suitable enclosed carrier for long-necked bottles, it would be highly desirable to provide a carrier of a design which is able to securely hold such articles, is not excessively costly, can be rapidly fabricated from a single blank and can readily be carried by consumers.

SUMMARY OF THE INVENTION

In accordance with the invention a sling-bottom carrier is provided which is comprised of front and back panels connected to side panels, and a bottom panel foldably connected to both the front and back panels. A top panel is also provided and is foldably connected to the front or back panel. The front, bottom, back and top panels are formed from a single sheet of material.

The interior of the panel is divided into cells by a main center partition, which is parallel to the front and back panels, and transverse partitions extending from the center partition to the front and back panels. The center partition includes a handle opening, and the top panel contains a handle access opening generally aligned with the center partition. This enables a user to reach through the access opening in the top panel and grasp the handle opening in the center partition to lift the carrier. The handle access opening in the top panel may also include a flap which normally covers the opening and which is designed to be pushed down about a center fold line. The flap may contain additional fold lines to form tabs which are designed to be folded out of the way upon the flap encountering a bottle as a user pushes the flap from its normal position to its folded-down position in the interior of the carrier.

The blank is formed with side panel sections formably connected to the front and back panel sections. In addition, each side panel section of one pair of sections is foldably connected to a center partition section. The center partition sections are adapted to be connected together in face-to-face relationship in the interior of the carrier. A flap is connected to one of the center partition sections for reinforcing the area originally occupied by the transverse partitions, and a handle reinforcing flap is connected to the other center partition to strengthen the handle area. This design provides for the center and transverse partition sections to be located on one side only of the sheet forming the front, back, bottom and top panels of the carrier, thus substantially economizing on the amount of paperboard required from which to form the blank.

The carrier of the present invention is economical and sturdy and able to fully enclose long-necked bottles, yet allows the customer to easily carry it. These and other aspects of the invention, as well as other benefits thereof, will readily be ascertained from the more detailed description of the invention which follows.

DESCRIPTION OF THE PREFERRED EMBODIMENT

Figure 1:
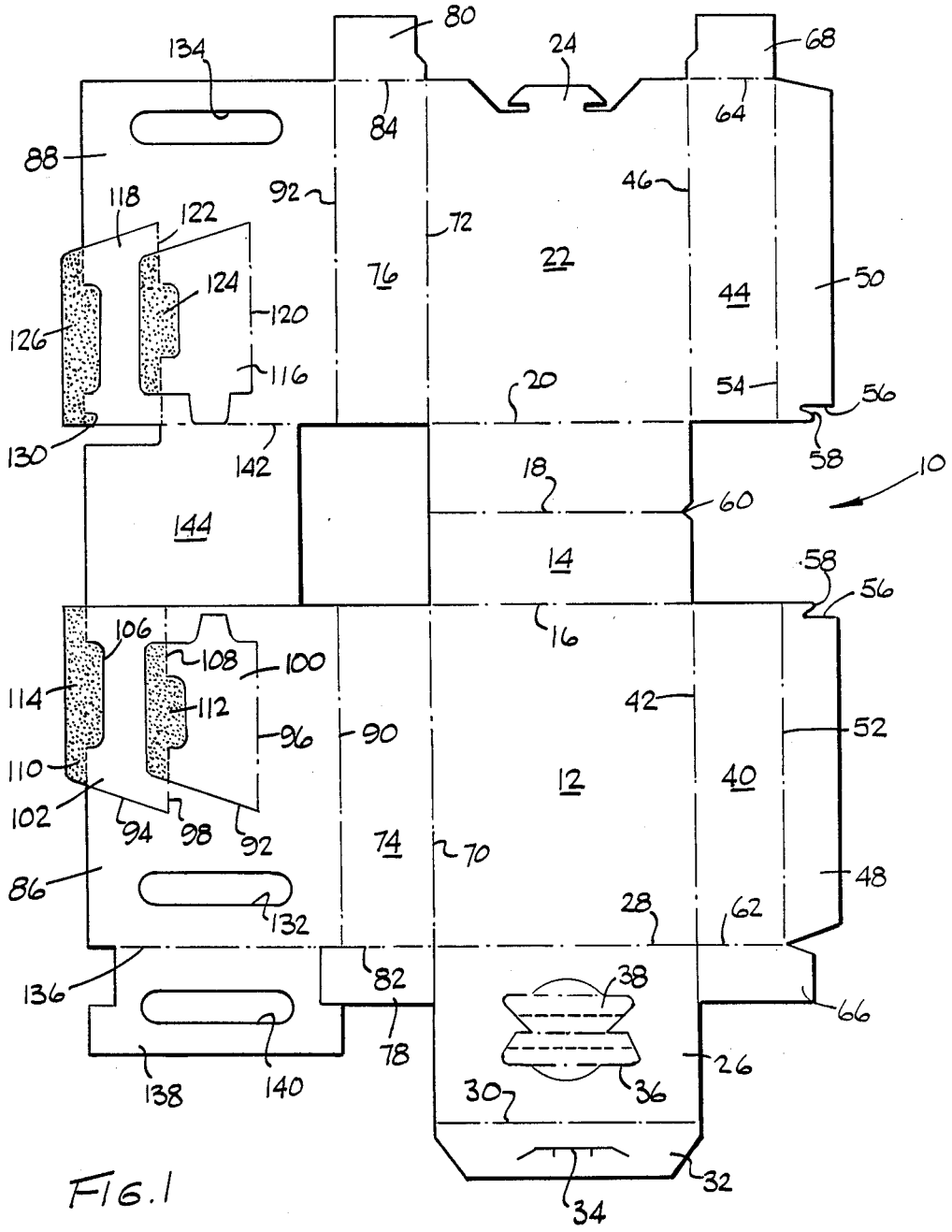
FIG. 1 is a plan view of the interior surface of a blank for forming the carrier of the present invention.

Referring to FIG. 1, a carrier blank 10 is comprised of a sheet of suitable material, such as paperboard, and includes a back panel section 12 connected to a bottom panel section 14 along score line 16. The bottom panel section 14 contains a score line 18 extending parallel to the score line 16 through the midpoint of the bottom panel section. Connected to the bottom panel section along score line 20 is a front panel section 22 which contains a locking tab 24 at its end opposite the score line 20. A top panel section 26 is connected to the back panel section 12 along score line 28, which is located at the end of the back panel section opposite the score line 16. Connected to the top panel section 26 along score line 30 is a flap 32 which contains a female locking slit 34 adapted to cooperate with the locking tab 24 to hold the top panel of a carrier formed from the blank in place. The top panel section 26 contains a centrally located opening 36 which is covered by a flap 38 described in more detail later.

A side panel section 40 is connected to the back panel section 12 along score line 42, and a second side panel section 44 is connected to the front panel section 22 along score line 46. Glue strips 48 and 50 are connected to the side panel sections 40 and 44 along score lines 52 and 54, respectively. The opposing edges of the glue strips contain notches 56 which form shoulder portions 58 adapted to contact the bottom panel of a carrier at the notch 60 in the center of the bottom panel edge. Connected to the outermost short edges of the side panel sections 40 and 44 along score lines 62 and 64, respectively, are dust flaps 66 and 68.

Connected to the back and front panel sections 12 and 22 along score lines 70 and 72, respectively, are side panel sections 74 and 76. As in the case of the side panel sections 40 and 44, the side panel sections 74 and 76 are connected to dust flaps 78 and 80, respectively, along score lines 82 and 84. Center partition sections 86 and 88 are connected to the side panel sections 74 and 76, respectively, along score lines 90 and 92. The center partition section 86 contains slits 92 and 94 and fold lines 96 and 98 which define transverse partition flaps 100 and 102. The transverse partition flaps are adapted to fold out of the plane of the center partition sections about the fold lines 96 and 98 during the forming of a carrier from the blank. Slits 104 and 106 and fold lines 108 and 110 define glue tabs 112 and 114 at the ends of the flaps 100 and 102. The glue tabs 112 and 114 are adapted to fold out of the plane of the transverse partition sections about the fold lines 108 and 110 and contact the back panel section 12 during the forming of a carrier so that the transverse partition flaps are connected to and extend between the center partition section 86 and the back panel section 12.

In a similar manner the other center partition section 88 is also provided with transverse partition flaps 116 and 118 which are connected to the center partition section along fold lines 120 and 122 and which have glue tabs 124 and 126. When the transverse partition flaps 116 and 118 are folded out of the plane of the center partition section 88, and when the glue tabs are fold out of the plane of the flaps along their fold lines 128 and 130, the glue tabs will contact the front panel section 22 during the forming of a carrier from the blank.

The center partition section 86 further includes a handle opening 132 in the outer central portion of the section. Similarly, the center partition section 88 also includes a handle opening 134 in its outer central portion. The handle openings 132 and 134 are adapted to be aligned with each other when the carrier is formed and the center partition sections are brought into face-to-face contact. The center partition section 86 is further connected along score line 136 to a handle reinforcing flap 138 which contains a handle opening 140. The handle opening 140 is adapted to be aligned with the handle openings 132 and 134 when the reinforcing flap 138 is folded about score line 136. In addition, the center partition section 88 is connected along score line 142 to a partition reinforcing flap 144 which when folded about the score line 142 covers the area vacated by the transverse partition flaps.

It can be seen that the blank is in the general shape of a rectangle, which is far more efficient as far as paperboard usage is concerned than the shapes normally associated with sling-bottom carrier blanks. This is made possible by the design of the blank which results in both center partition sections being located on the same side of the area forming the front, back and bottom panel sections.

The score lines 42 and 46 are spaced the same distance from, and are parallel to, the score lines 70 and 72, so that the front and back panels are of the same width. Similarly, the score lines 52, 54, 90 and 92 are located so that the center partition sections are similar in size to the front and back panels and so that the side panel sections are all of the same size.

Figure 2:
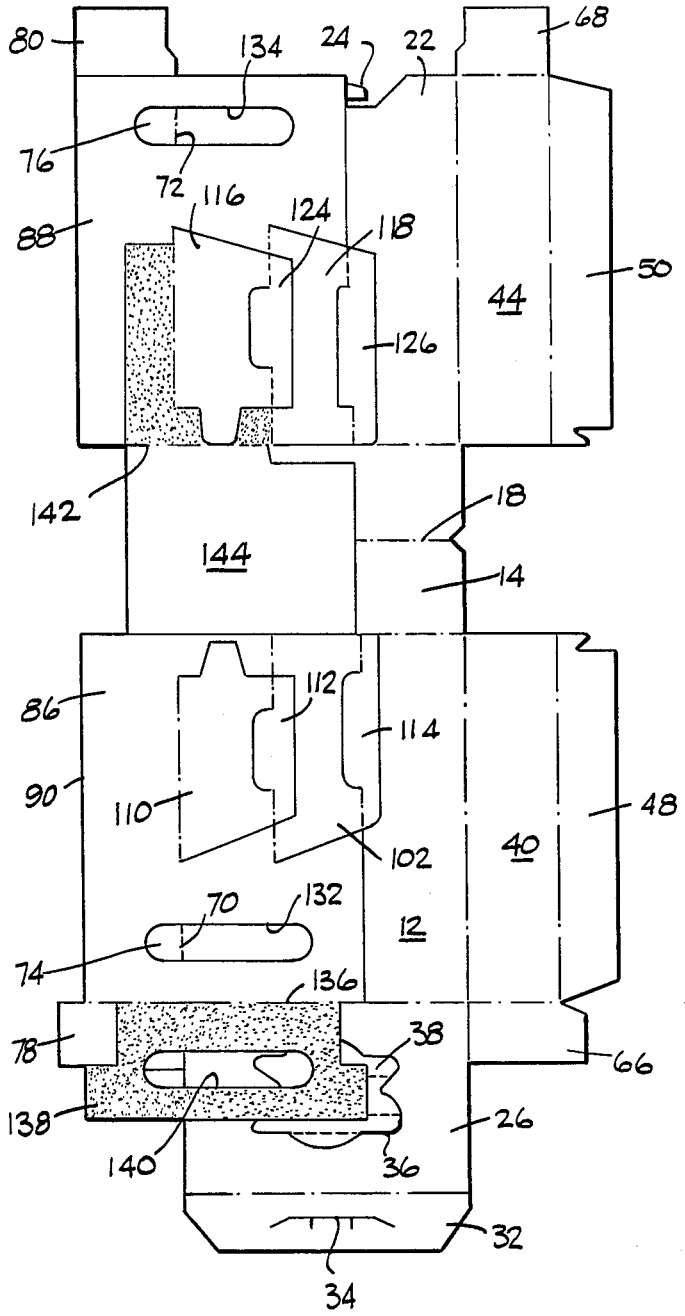
FIG. 2 is a plan view of the blank of FIG. 1 shown after an initial folding operation has been carried out.

To form a carrier from the blank of FIG. 1, the glue tabs 112, 114, 124 and 126 are coated with adhesive, as shown by the stippled portions of FIG. 1, and the center partition sections 86 and 88 are folded about score lines 90 and 92. The resulting configuration is shown in FIG. 2, wherein the left edge of the folded blank now coincides with the score lines 90 and 92. The glue tabs 112 and 114 are now adhered to the inside surface of the front panel section 22 while the glue tabs 124 and 126 are now adhered to the inside surface of the back panel section 12.

The next step in forming a carrier is to coat the center partition section 88 in the stippled area of FIG. 2 and to coat the handle reinforcing flap 138, also shown in FIG. 2 as a stippled area. The center partition reinforcing flap 144 is then folded about fold line 142 to adhere it to the center partition section 88, and the handle reinforcing flap 138 is folded about fold line 136 to adhere it to the center partition section 86. Note that the glue pattern on the center partition section 88 precludes the flap 144 from adhering to the transverse partition flaps 116 or 118. The resulting partially formed carrier blank is shown in FIG. 3.

Figure 3:
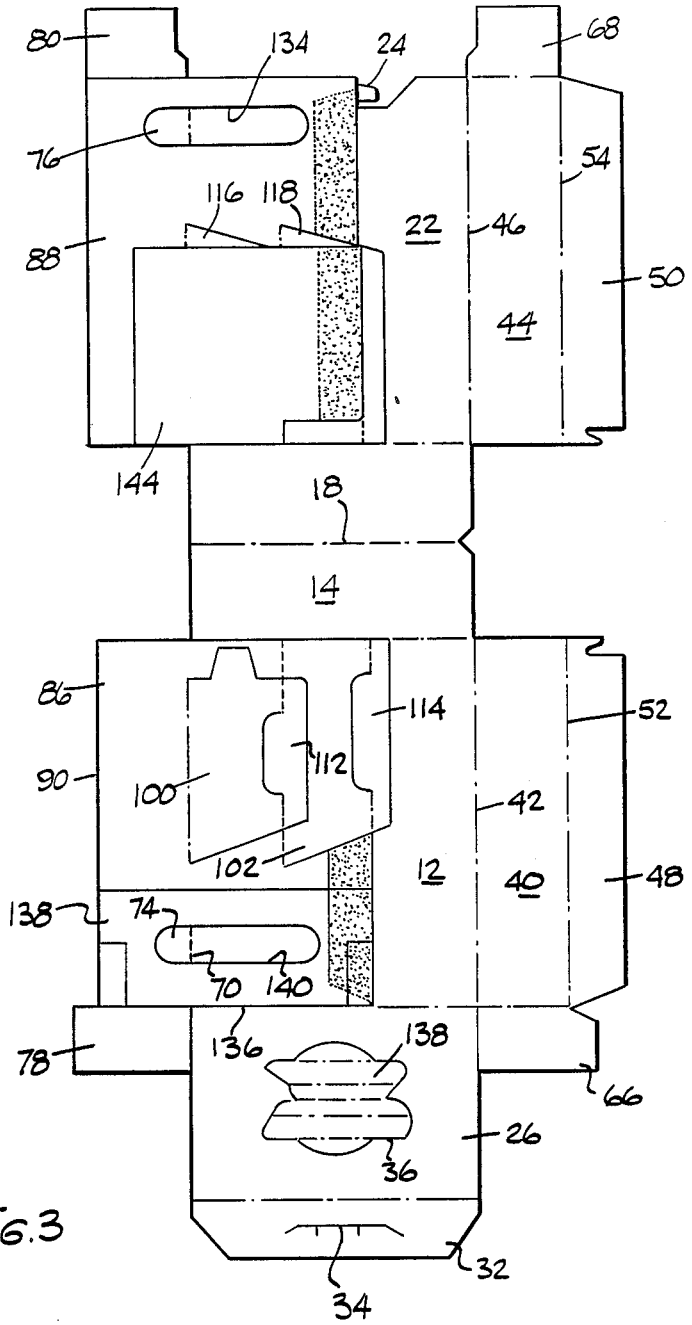
FIG. 3 is a plan view of the blank of FIG. 1 after a second folding operation has been carried out.
Figure 4:
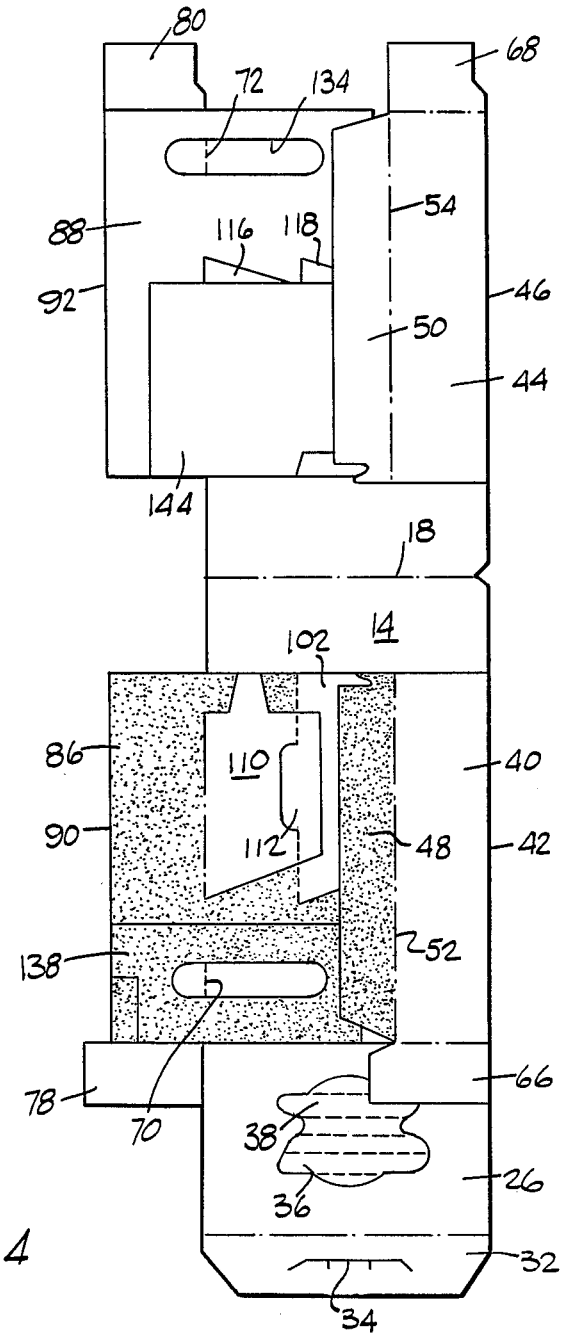
FIG. 4 is a plan view of the blank of FIG. 1 after still another folding operation has been carried out.

The next step is to coat the stippled areas shown in FIG. 3 with adhesive and to fold the side panel sections 40 and 44 inwardly about score lines 42 and 46 to bring the side panel sections to the position shown in FIG. 4. The right edge of the folded blank now coincides with score lines 42 and 46. The glue flaps 48 and 50 are adhered to the center partition sections 86 and 88 at the stippled areas, which are patterned to avoid adhering the glue strips to any portions of the transverse partition flaps 102 and 118 so as not to interfere with subsequent movement of the transverse partition flaps to their final position.

Figure 5:
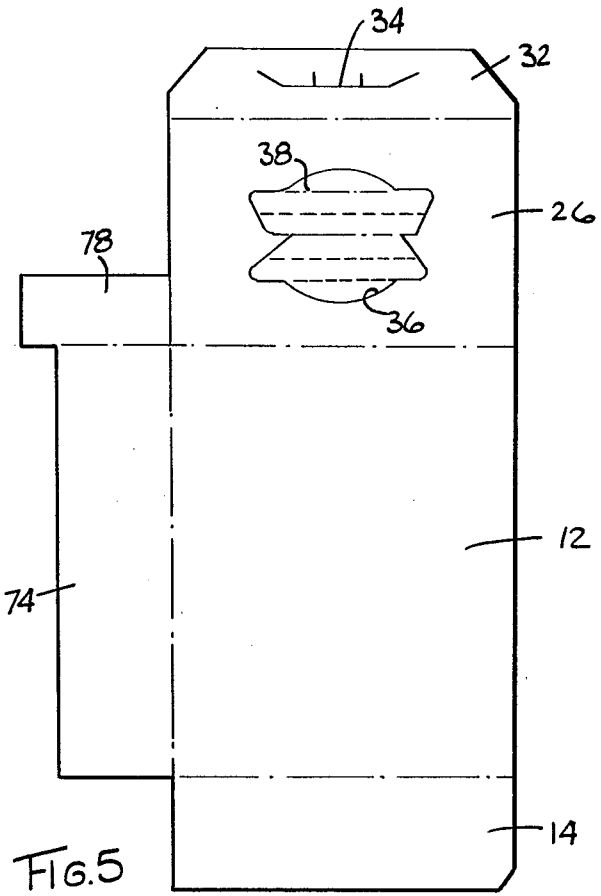
FIG. 5 is a plan view of a fully folded blank in condition to be opened into carrier form.

The final steps in forming the carrier blank are shown in FIGS. 4 and 5. The areas shown in stipple in FIG. 4 are coated with adhesive and the blank is folded about the score line 18 to bring the glue strips 48 and 50 into contact and also to bring the center partition section 86 into contact with the center partition section 88. This also results in providing a triple thickness of material in the handle area due to the presence of the handle reinforcement flap 138 between the center partitions 86 and 88. The placement of the adhesive still avoids the transverse partition flaps in order not to prevent their subsequent movement into final position. Although the adhesive is illustrated as being applied to only one of the surfaces to be adhered together, it will be understood that it could be applied to both surfaces if desired. Note that as a result of the folding operation the outer surfaces of the various panels are visible rather than the inside surfaces previously depicted. The folded blank is now in condition to be shipped to the packaging operation location where it is opened to the position shown in FIG. 6 in order to receive the articles to be packaged. It will be understood that the folded blank is opened merely by exerting inward pressure on the left edge of the folded blank as shown in FIG. 5, which now corresponds to the adhered edges 90 and 92, and on one of the right edges 42 or 46. The adherence of the glue tabs of the transverse partition flaps to the front and back panels of the carrier causes the transverse flaps to move to a position at right angles to the center partition in order to create the article-receiving cells of the carrier.

Figure 6:
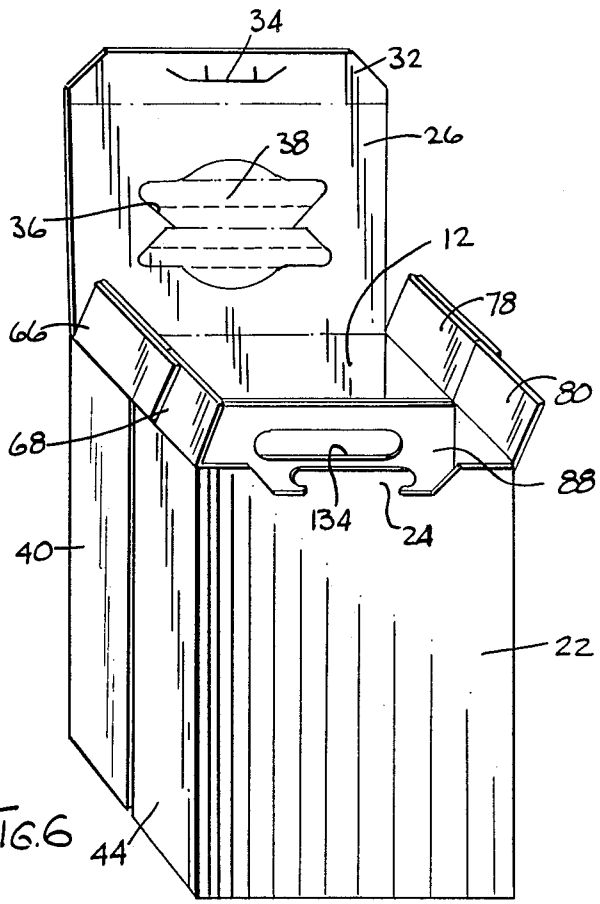
FIG. 6 is a pictorial view of the carrier of the present invention as it would appear after the blank of FIG. 5 has been opened.
Figure 7:
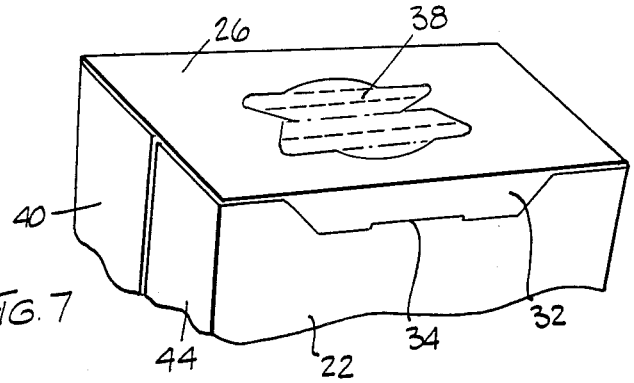
FIG. 7 is a partial pictorial view of the top portion of the carrier of FIG. 6 after the bottles have been loaded and the top closed.

Referring now to FIG. 6, which for clarity is shown with the front panel facing the viewer, it can be seen that the visible side panel is comprised of the adjacent panel sections 40 and 44, with dust flaps 66 and 68 extending upwardly. The hidden side panel is comprised of adjacent panel sections 74 and 76, with dust flaps 78 and 80 extending upwardly. The center partition, which is now a composite but has been designated by reference numeral 88, is shown as being located in the center of the carrier parallel to the front and back panels and with the handle opening near the top of the carrier. To complete the formation of the package it is merely necessary to fill the carrier with the articles to be packaged, placing them in the cells formed by the transverse partition flaps, fold down the dust flaps, close the top panel and insert the locking tab 24 through the slit 34 in the top panel flap 32. The finished package then appears as shown in FIG. 7, which completely encloses the contents of the package.

Figure 8:
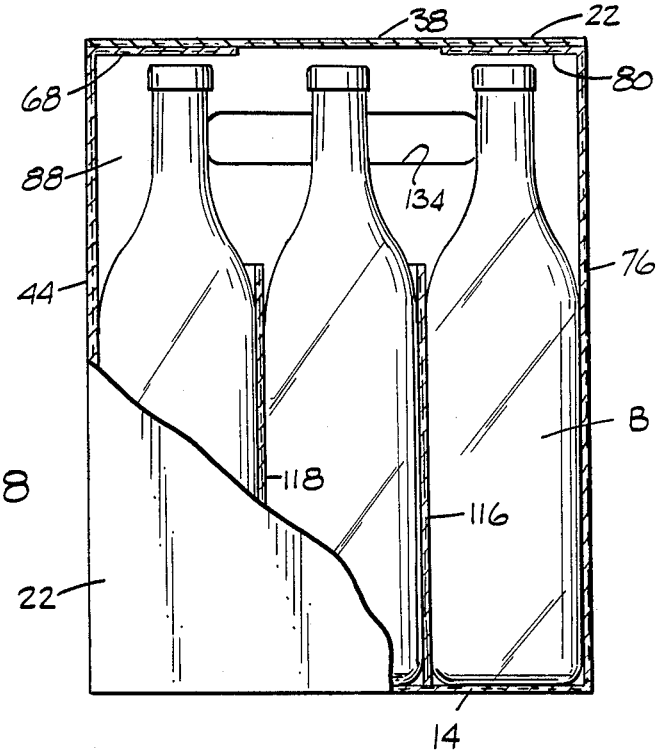
FIG. 8 is a front elevation, shown partially in section, of a fully loaded carrier.

As shown in FIG. 8, the long-necked bottles B are securely held in place between the outer panels of the carrier, the center partition and the transverse partition flaps. The necks of the bottles extend up close to the top panel 22 while the handle opening 134 in the center partition 88 is located in the vicinity of the bottle necks. The closed top panel of the carrier would normally not permit the hand of a user to reach into the carrier to grasp the handle. The handle access opening 36 in the top panel, however, is designed to permit access to the interior of the carrier.

Figure 9:
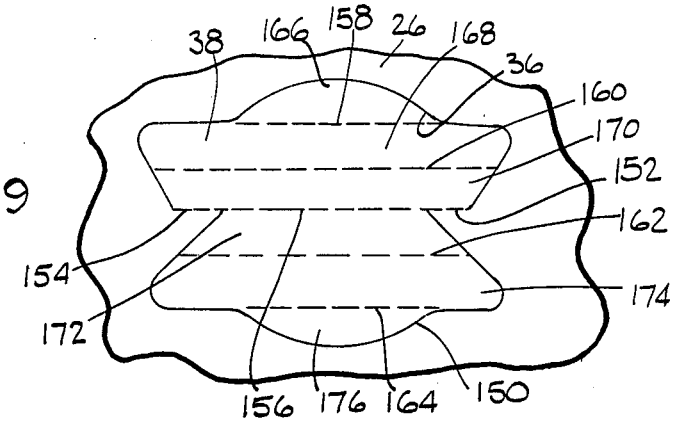
FIG. 9 is an enlarged partial plan view of the top panel of the carrier, showing the handle opening flap.

Referring to FIG. 9, the handle access opening 36 is normally covered by the flap 38 which is defined by a slit 150 and fold line segments 152 and 154. The fold line segments are extensions of a centrally located fold line 156 in the flap which is generally aligned with the top edge of the center partition in the package below it. This arrangement permits the cover flap 38 to be pushed downwardly to cause the flap to fold about the fold lines 152, 154 and 156. The flap is further provided with spaced parallel fold lines 158, 160, 162 and 164 which form tabs 166, 168, 170, 172, 174 and 176 for a purpose made clear below.

Figure 10A:
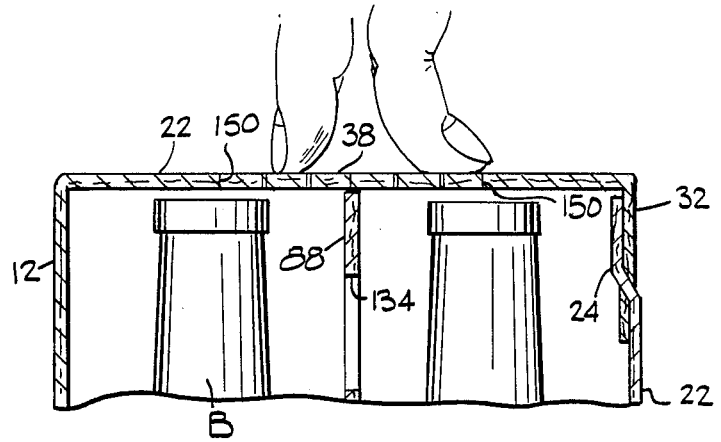
FIGS. 10A–10C are partial longitudianl sectional views sequentially illustrating the steps of grasping the handle opening in the center partition.
Figure 10B:
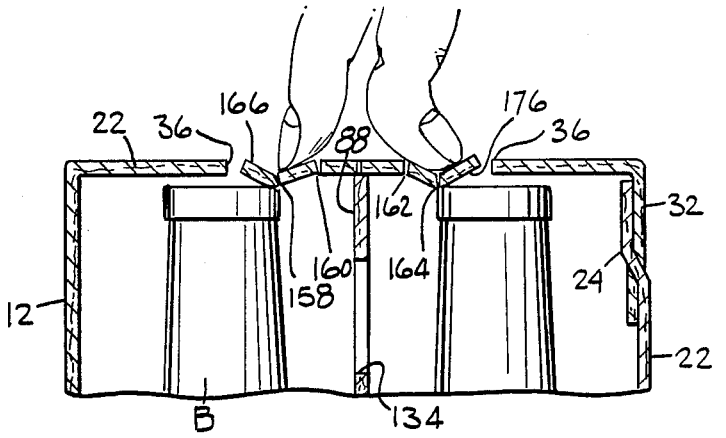
Figure 10C:
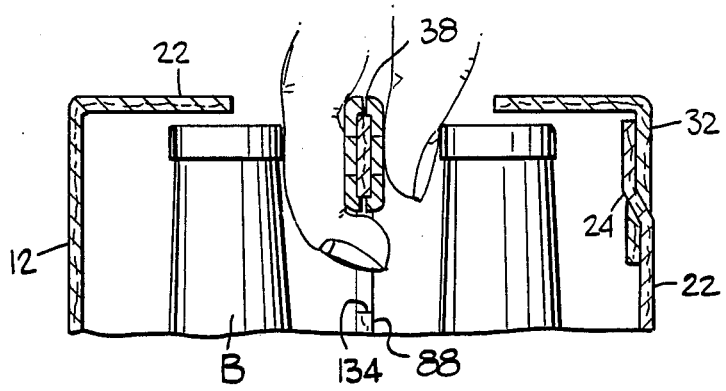

As shown in FIG. 10A, when a user wishes to pick up the carrier it is merely necessary to press down on the flap 38 with the thumb and fingers on either side of the center fold line 156. This causes the flap to be separated from the top panel at the slit 150, as shown in FIG. 10B, and the outermost tabs 166, 168, 174 and 176 to be pushed down toward the interior of the carrier. Because the thickness of the bottles prevents them from being spaced far apart, the bottle necks are close to the center partition 88. The outer tabs 166 and 176 will contact the bottle tops, but because of the fold lines 158 and 164 the tabs will fold up and move past the bottle necks as continued downward pressure is applied. It will be appreciated that further continued pressure will cause the same type of folding action to occur with respect to the fold lines 160 and 162, causing the other tabs 168, 170, 172 and 174 to fold downwardly until the flap has been folded down on either side of the center partition as shown in FIG. 10C. This arrangement permits the handle access opening 36 to be covered prior to use and yet allow sufficient space for the hand of a user to extend down into the package to the handle opening in the center partition. In addition, the access opening flap provides a cushion to soften the handle opening edges which the hand would normally contact during lifting of the carrier.

It will now be appreiciated that the invention provides a simple yet very effective carrier for completely enclosing articles such as long-necked bottles, which heretofore had to be packaged in other less desirable cartons, and provides a blank which makes economical use of the material from which it is formed.

It should now be understood that the invention is not necessarily limited to all the specific details described in connection with the preferred embodiment, but that changes to certain features of the preferred embodiment which do not affect the overall basic function and concept of the invention may be made by those skilled in the art without departing from the spirit and scope of the invention, as defined in the appended claims.

What is claimed is:

1. A sling-bottom article carrier, comprising:

a front panel and a back panel connected to side panels to form a four-sided carrier;

each side panel being comprised of two connected panel sections, one of the side panel sections being foldably connected to the front panel and the other side panel section being foldably connected to the back panel;

a bottom panel foldably connected to both the front and back panels;

a top panel foldably connected to at least one of the front or back panels;

the front, bottom, back and top panels being formed from a single sheet of material;

a center partition inside the carrier extending from one side panel to the other side panel, the center partition being foldably connected to the side panels and being substantially parallel to the front and back panels;

transverse partitions foldably connected to the center partition and extending between the center partition and the front and back panels, the transverse partitions dividing the space between the center partition and the front and back panels into article-receiving cells;

the top panel being foldably connected to one of the front or back panels and spanning the distance between the front and back panels, the carrier further including means for mechanically interlocking the top panel with the front or back panel to which the top panel is not foldably connected; and the center partition containing a handle opening and the top panel containing a handle access opening generally aligned with the center partition, whereby a user may reach through the handle access opening in the top panel and grasp the handle opening in the center partition to lift the carrier.

2. An article carrier according to claim 1, including a flap covering the handle access opening, the flap being foldably connected to the top panel in a region substantially aligned with the center partition and being capable of being easily separated from the top panel about the remainder of the perimeter of the flap, thereby enabling a user to push the handle access flap down on either side of the center partition.

3. An article carrier according to claim 2, wherein the handle access flap contains at least one fold line on either side of the fold line which is aligned with the center partition, the fold lines extending substantially parallel to the center partition and dividing the handle access flap into tabs, the tabs being adapted, upon encountering an article in the carrier situated in the path of movement of the handle access flap, to fold about their fold lines to allow the flaps to be pushed down on either side of the center partition.

* * * * *